US007227279B2

(12) United States Patent
Kim

(10) Patent No.: US 7,227,279 B2
(45) Date of Patent: Jun. 5, 2007

(54) PHASE DEFICIENCY DISPLAY DEVICE FOR THERMAL MAGNETIC TYPE MOLDED CASE CIRCUIT BREAKER

(75) Inventor: Ho Soung Kim, Cheongju-si (KR)

(73) Assignee: LG Industrial Systems Co., Ltd., Seoul (KR)

( * ) Notice: Subject to any disclaimer, the term of this patent is extended or adjusted under 35 U.S.C. 154(b) by 460 days.

(21) Appl. No.: 10/724,712

(22) Filed: Dec. 2, 2003

(65) Prior Publication Data

US 2004/0114295 A1 Jun. 17, 2004

(30) Foreign Application Priority Data

Dec. 14, 2002 (KR) ..... 10-2002-0079968

(51) Int. Cl.
*H01H 71/16* (2006.01)
*H01H 71/04* (2006.01)
*H01H 77/00* (2006.01)

(52) U.S. Cl. ..... 307/116

(58) Field of Classification Search ..... 307/116, 307/117; 335/17, 31
See application file for complete search history.

(56) References Cited

U.S. PATENT DOCUMENTS 4,554,524 A * 11/1985 Radus ..... 337/3
4,827,231 A * 5/1989 Cheski et al. ..... 335/17
4,969,063 A * 11/1990 Scott et al. ..... 361/93.1
5,079,530 A * 1/1992 Tsuchiyama ..... 335/17
5,193,043 A * 3/1993 Grunert et al. ..... 361/99
5,353,014 A * 10/1994 Carroll et al. ..... 340/638
6,396,370 B2 * 5/2002 Leone et al. ..... 335/35
6,466,424 B1 * 10/2002 Larranaga et al. ..... 361/103
6,542,056 B2 * 4/2003 Nerstrom et al. ..... 335/17
6,600,396 B1 * 7/2003 Rodriguez et al. ..... 335/132

* cited by examiner

*Primary Examiner*—Brian Sircus
*Assistant Examiner*—Adi Amrany
(74) *Attorney, Agent, or Firm*—Greenblum & Bernstein, P.L.C.

(57) ABSTRACT

Disclosed is a display device for a thermal magnetic type molded case circuit breaker capable to display a phase deficiency occurred on a line to a user such that the user rapidly deals with the phase deficiency and prevents loss caused by over-heating generated due to the phase deficiency. The thermal magnetic type molded case circuit breaker has a bimetal, which is bendable when heat is applied thereto, and a shifter coupled to an upper end of the bimetal and horizontally moved corresponding to a bending degree of the bimetal when over-current is applied thereto. The display device includes a power source for supplying electric power, a display for displaying the phase deficiency of the thermal magnetic type molded case circuit breaker by receiving power from the power source, a stationary contactor electrically connected to the power source and having a stationary contact, and a movable contactor electrically connected to the display and having a movable contact. The movable contactor vertically moves and forms a circuit together with the power source section and the display for displaying the phase deficiency state when the movable contact contacts with the stationary contact. A interlock lever rotates according to a horizontal movement of the shifter. A connection bar makes contact with both shifter and interlock lever so as to transfer horizontal moving force of the shifter to the interlock lever. A latch lever is installed adjacent to the interlock lever in order to restrict a movement of the movable contactor when normal current is applied and to release a restriction of the movable contactor when the phase deficiency occurs.

6 Claims, 8 Drawing Sheets

PHASE DEFICIENCY DISPLAY DEVICE FOR THERMAL MAGNETIC TYPE MOLDED CASE CIRCUIT BREAKER

BACKGROUND OF THE INVENTION

1. Field of the Invention

The present invention relates to a phase deficiency display device of a thermal magnetic type molded case circuit breaker for protecting lines and electric load devices in an electric power system by breaking a fault current, such as overload, short circuit current and electrical leakage when fault current is generated on the power lines, and more particularly to the phase deficiency display device for the thermal magnetic type molded case circuit breaker capable of displaying a phase deficiency generated on the power lines.

2. Description of the Prior Art

As generally known in the art, a molded case circuit breaker is installed in a power distributing board of power receiving and distributing equipment provided in factories and buildings. In a no-load state, the molded case circuit breaker acts as a switching device for supplying or breaking electric power to a electrical load. In a load state, the molded case circuit breaker acts as an electric power breaker for breaking electric power supplied to the load from a power source so as to protect a cables of an electric circuit and devices of the load if large current exceeding rated load current flows due to fault on a load line.

Therefore, various kinds of molded case circuit breakers having various frame sizes, poles and operating manners are fabricated. Basically, the molded case circuit breakers have various elements including a mold case, a contact, a trip device, a switching mechanism, an arc chamber, and a terminal.

Hereinafter, the above elements of the molded case circuit breakers will be described.

The mold case includes a case and a cover, which are made of insulating material. The mold case forms a container in order to receive various elements in such a manner that elements installed in the case and each element of phases (so called pole) is insulated from each other. The mold case protects persons from an electric shock derived from internal elements in the mold case and has a structure capable of preventing impurities from penetrating into the mold case.

The contactor includes a movable contactor and a stationary contactor. The contactor is installed for each pole so as to open or close an electric circuit.

The trip device trips the switching mechanism when the device detects over-current or short circuit current.

The switching mechanism drives the movable contactor when the trip device trips the switching mechanism. In addition, it is possible to manually drive the movable contactor by using the switching mechanism. The switching mechanism can automatically perform a switching operation.

The arc chamber extinguishes arc created between the movable contactor and the fixed contactor.

The terminal is assembled into each pole of a power source part and a load part so as to connect an external electric wire or an external conductor to an internal conductor.

Tripping device is installed in the molded case circuit breaker so as to detect over-current The trip device is classified into a hydraulic-magnetic type trip device using viscosity of silicon oil, a thermal magnetic type trip device using a bending characteristic of a bimetal and having fixed and movable cores, and an electronic type trip device using a semiconductor device.

The thermal magnetic type trip device performs a time-delay trip, in which a heater generates heat caused by over-current and the bimetal is bent due to the heat, thereby automatically breaks the electrical circuit, and an instantaneous trip, in which the fixed core attracts the movable core when relatively great over-current is applied, thereby automatically shutting off the electric circuit. That is, according to the time-delay trip, the molded case circuit breaker is operated to a breaking position due to a bending action of the bimetal. In addition, in case of instantaneous trip, the fixed core attracts the movable core based on the principle of an electromagnetic suction, thereby the molded case circuit breaker is operated to a brealing position.

As shown in FIG. 1, such conventional thermal magnetic type molded case circuit breaker includes a mold case 1, a bimetal 2, which is bent in proportion to a heat of a heater 3 when current is applied thereto, first and second shifters 4 and 5, which are coupled to an upper end of the bimetal 2 and horizontally movable in proportion to a bending degree of the bimetal 2 when over-current is applied thereto, and a shifter lever 6 inserted into through holes formed in the first and second shifters 4 and 5 by interposing protrusions therebetween in such a manner that the shifter lever 6 is rotated at a predetermined angle according to the movement of the first and second shifters 4 and 5, thereby rotating a latch of a driving section (not shown) so as to shut off electric power. Reference numerals 14 and 7 represent a connection bar and an auxiliary device frame, respectively.

Hereinafter, an operation of the conventional thermal magnetic type molded case circuit breaker will be described.

Firstly, when rated current is applied, the heater 3 generates heat, causing the bimetal 2 to bend.

At this time, the first and second shifters 4 and 5 coupled to the upper end of the bimetal 2 are horizontally moved in a same direction as a bending direction of the bimetal 2.

As mentioned above, the first and second shifters 4 and 5 are formed with through holes, and the protrusions of the shifter lever 6 are inserted into the through holes.

When normal current is applied, the bimetal 2, which has been bent at a predetermined degree due to heat generated from the heater 3, moves the first and second shifters 4 and 5 in the bending direction of the bimetal 2 corresponding to a bending distance thereof.

At this time, if the phase deficiency occurs at one phase current of three phases (R, S and T phases) alternating currents, electric current flows to concentrate the remaining two phases, so over-current occurs, thereby causing damage to a load connected to the conventional thermal magnetic type molded case circuit breaker.

In addition, since current does not flow through the phase occurred phase deficiency, the heater 3 for the phase cannot generate heat so that the bimetal 2, which has been bent, recovers its initial shape. At this time, if the bimetal 2 is developed in a direction opposite to the bending direction thereof in order to recover its initial shape, the shifter 5 also moves in the direction opposite to the bending direction of the bimetal 2. In addition, the shifter lever 6 is rotated in the bending direction due to the movement of the shifter 5 so that an end portion of the shift lever 6 rotates the latch of the driving section (not shown), thereby breaks the circuit.

In addition, an accessory device is coupled to a body of the conventional thermal magnetic type molded case circuit breaker. When an error occurs in a load or a power source part due to fault current, a detecting section and a switching mechanism are operated so as to perform a trip operation for disconnecting a contact of a contact section. At this time, the accessory device is operated together with the detecting section and the switching mechanism, thereby displaying a signal to an exterior.

However, although the conventional thermal magnetic type molded case circuit breaker having the above structure can display the trip operation caused by fault current, such as over-current and instantaneous current, to the exterior, the conventional thermal magnetic type molded case circuit breaker has no display function for the trip operation caused by the phase deficiency.

When the phase deficiency occurs at one of three phases (R, S and T phases), heat is generated from lines of the load part, causing a remarkable loss of the lines. However, according to the conventional thermal magnetic type molded case circuit breaker, it is difficult to recognize the reason of the trip operation. That is, it is difficult to know whether the trip operation is derived from fault current, such as over-current and instantaneous current, or from the phase deficiency, so it is impossible to rapidly deal with the phase deficiency

SUMMARY OF THE INVENTION

Accordingly, the present invention has been made to solve the above-mentioned problems occurring in the prior art, and an object of the present invention is to provide the phase deficiency display device for a thermal magnetic type molded case circuit breaker capable of displaying a phase deficiency to a user when the phase deficiency occurs on the lines in such a manner that the user can rapidly deal with the phase deficiency and can prevent loss caused by heat generated due to the phase deficiency.

To accomplish the above object, the present invention provides a phase deficiency display device for a thermal magnetic type molded case circuit breaker provided with a bimetal, which is bendable when heat is applied thereto, and a shifter coupled to an upper end of the bimetal and horizontally movable corresponding to a bending degree of the bimetal when over-current is applied thereto, the display device comprising:

a power source for supplying electric power, a display connected to the power source for displaying a phase deficiency;

a stationary contactor electrically connected to the power source and having a stationary contact;

a movable contactor electrically connected to the display and having a movable contact, the movable contactor vertically movable and forming a circuit together with the power source and the display for displaying the phase deficiency state when the movable contact contacts with the fixed contact;

an interlock lever rotated according to a horizontal movement of the shifter;

a connection bar connected to the shifter and the interlock lever for transferring horizontal moving force of the shifter to the interlock lever, and a latch lever installed adjacent to the interlock lever for restricting a movement of the movable contactor when normal current is applied and to release a restriction of the movable contactor when the phase deficiency occurs.

BRIEF DESCRIPTION OF THE DRAWINGS

The above and other objects, features and advantages of the present invention will be more apparent from the following detailed description taken in conjunction with the accompanying drawings, in which:

FIGS. 4A to 4C are operational views of an phase deficiency display device of a thermal magnetic type molded case circuit breaker according to one embodiment of the present invention, in which FIG. 4A represents a state before power is applied to the thermal magnetic type molded case circuit breaker, FIG. 4B represents a normal state of the thermal magnetic type molded case circuit breaker, and FIG. 4C represents a trip state of the thermal magnetic type molded case circuit breaker due to the phase deficiency; and FIGS. 5A and 5B are views showing the phase deficiency display device of the thermal magnetic type molded case circuit breaker according to one embodiment of the present invention, in which FIG. 5A represents a normal state of the thermal magnetic type molded case circuit breaker, and FIG. 5B represents a trip state of the thermal magnetic type molded case circuit breaker due to the phase deficiency.

DETAILED DESCRIPTION OF THE PREFERRED EMBODIMENTS

Figure 1:
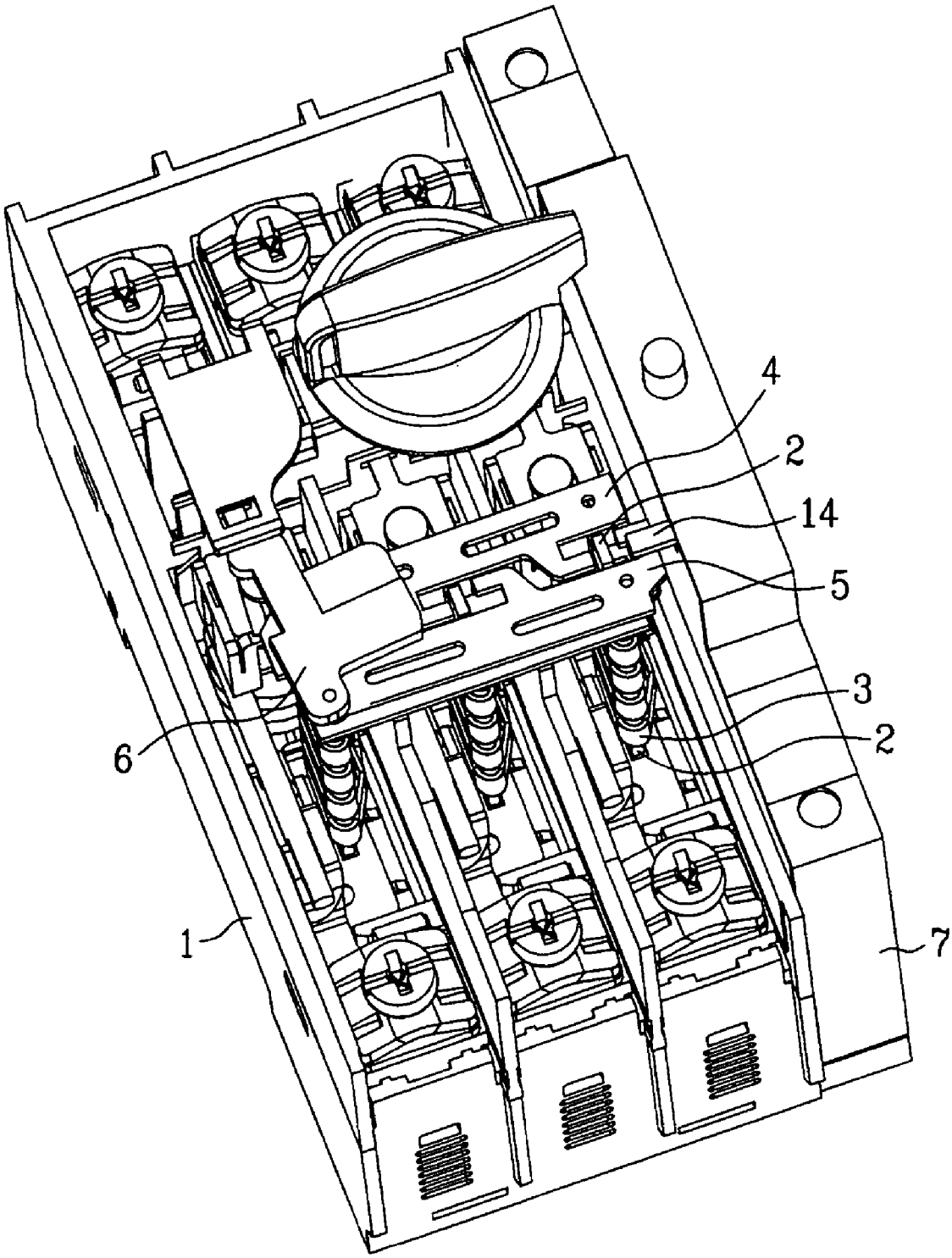
FIG. 1 PRIOR ART
FIG. 1 is a perspective view showing a conventional thermal magnetic type molded case circuit breaker.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
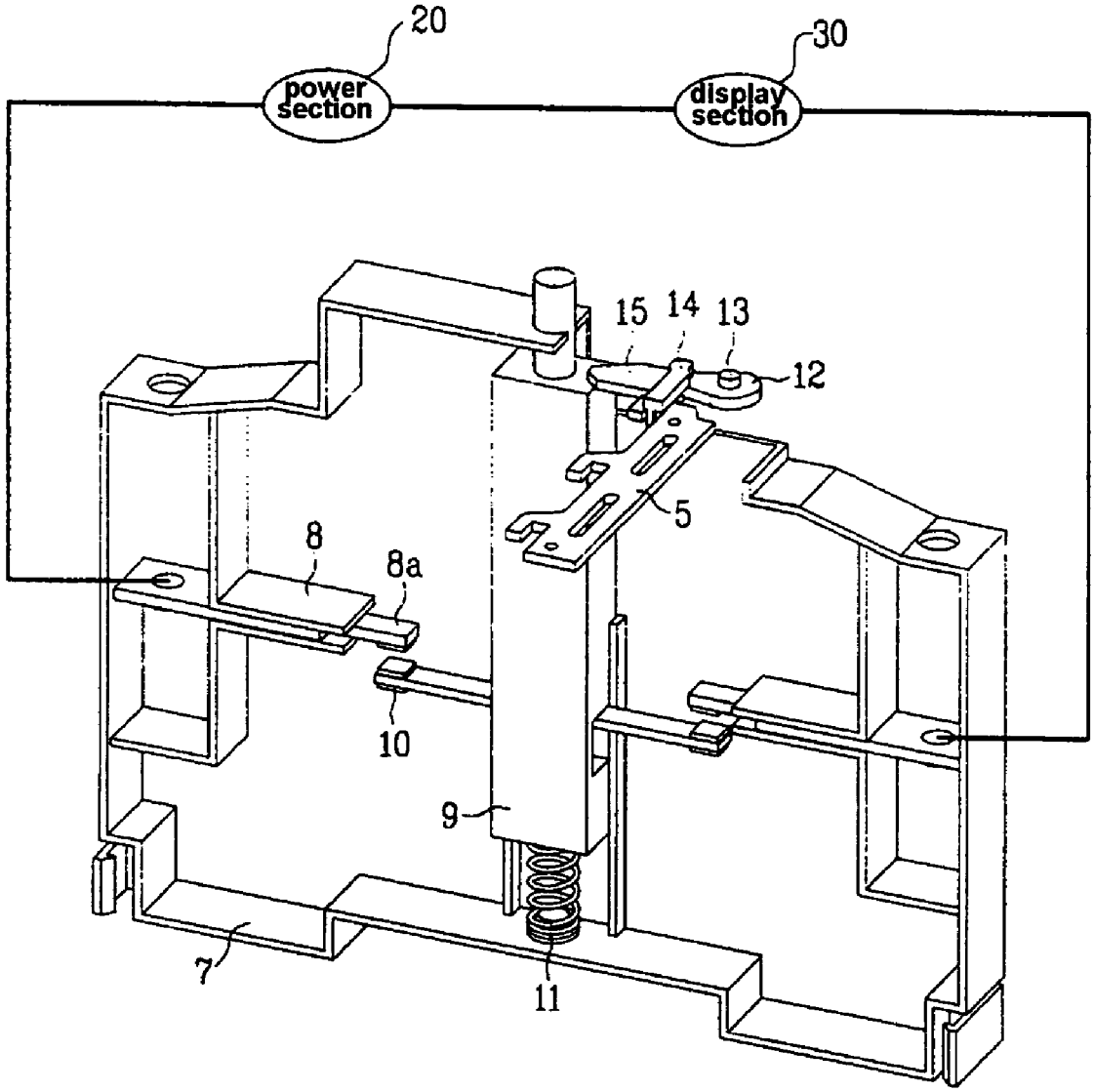
FIG. 2 is a perspective view showing an phase deficiency display device of a thermal magnetic type molded case circuit breaker according to one embodiment of the present invention.
Figure 3:
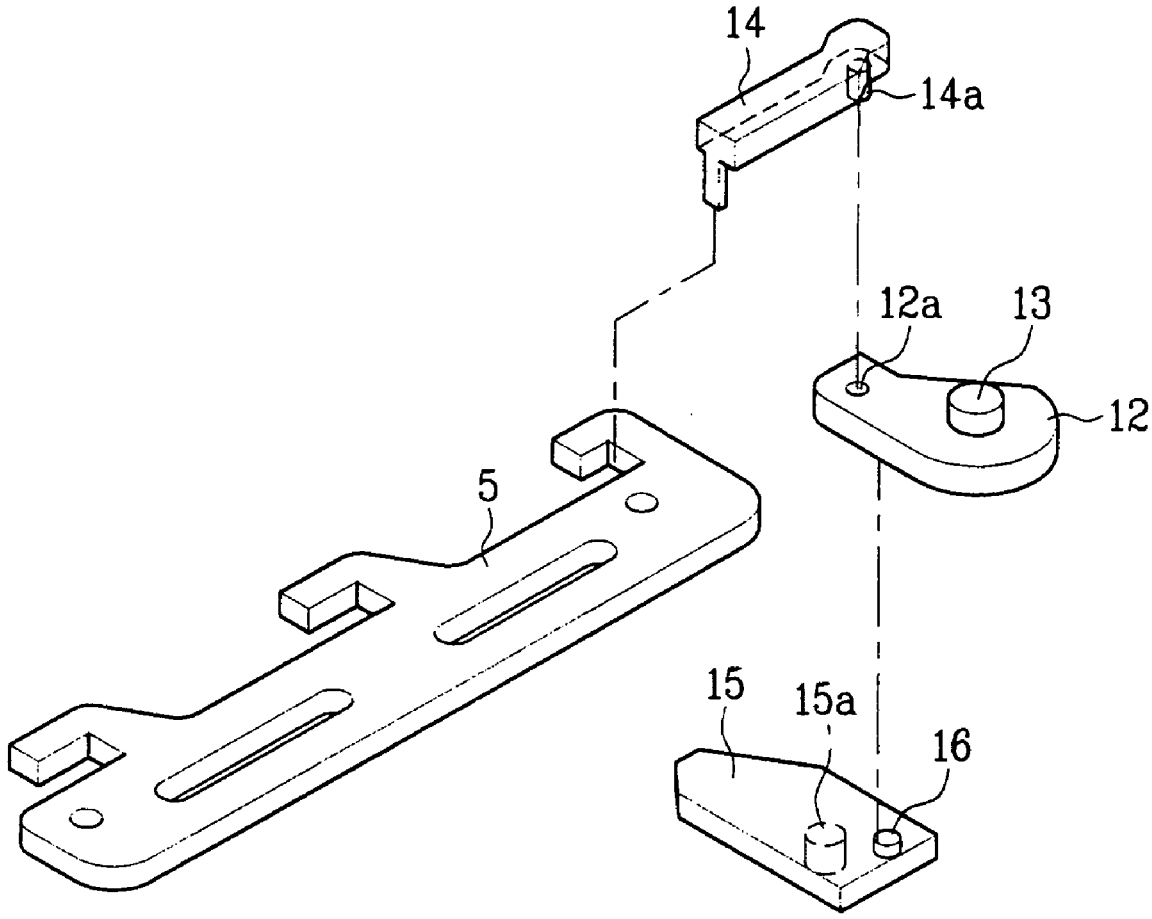
FIG. 3 is an exploded view of a part shown in FIG. 2.

FIG. 2 is a perspective view showing an open-phase display device of a thermal magnetic type molded case circuit breaker according to one embodiment of the present invention, and FIG. 3 is an exploded view of a part shown in FIG. 2.

The phase deficiency display device of the thermal magnetic type molded case circuit breaker according to one embodiment of the present invention displays the phase deficiency by transferring the phase deficiency signal to an accessory device by using first and second shifters installed in a mold case of the thermal magnetic type molded case circuit breaker.

Hereinafter, the phase deficiency display device of the thermal magnetic type molded case circuit breaker according to one embodiment of the present invention will be described with reference to FIGS. 1 to 3. The thermal magnetic type molded case circuit breaker has a structure identical to the conventional thermal magnetic type molded case circuit breaker shown in FIG. 1. That is, as shown in FIG. 1, the thermal magnetic type molded case circuit breaker includes a mold case 1, a bimetal 2, which is bent in proportion to the heat of a heater 3 when current is applied thereto, first and second shifters 4 and 5, which are coupled to an upper end of the bimetal 2 and horizontally moved in proportion to a bending degree of the bimetal 2 when over-current is applied thereto, and a shifter lever 6 inserted into through holes formed in the first and second shifters 4 and 5 by interposing protrusions therebetween in such a manner that the shifter lever 6 is rotated at a predetermined angle according to the movement of the first and second shifters 4 and 5, thereby rotating a latch of a driving section (not shown) so as to break the circuit. Reference numerals 14 and 7 represent a connection bar and an accessory device frame, respectively.

The connection bar 14 is installed between the first and second shifters 4 and 5 and an interlock lever 12. When the first and second shifters 4 and 5 horizontally move due to the phase deficiency, horizontal moving force of the first and second shifters 4 and 5 is transferred to the interlock lever 12, so that the interlock lever 12 rotates.

In addition, the shifter lever 6 is coupled to first and second shifters 4 and 5. The shifter lever 6 is connected to the bimetal 2 in such a manner that the shifter lever 6 moves in a left direction or a right direction according to a bending direction of the bimetal 2.

When rated current is applied, the heater 3 generates heat so that the bimetal 2 bends in the left direction in proportion to the heat At this time, the first and second shifters 4 and 5 coupled to the upper end of the bimetal 2 are horizontally moved in the same direction as the bending direction of the bimetal 2.

As mentioned above, the first and second shifters 4 and 5 are formed with holes, and the protrusions of the shifter lever 6 are inserted into the holes.

When normal current is applied, the bimetal 2, which has been bent at a predetermined degree due to heat generated from the heater 3, moves the first and second shifters 4 and 5 in the left direction corresponding to a bending distance thereof.

At this time, if the phase deficiency occurs at one of three phases (R, S and T phases), current does not flow through the phase having the open-phase. Thus, the heater 3 cannot generate heat, so that the bimetal 2, which has bent, recovers its initial shape. That is, the bimetal 2 bends in the right direction.

The accessory device frame 7 is provided with a stationary contactor 8 having a stationary contact 8*a* and a movable contactor 9 having a movable contact 10. The stationary contactor 8 is connected to an electrical power source 20, and the movable contactor 9 is electrically connected to a display 30. The movable contactor 9 can vertically move. When the movable contact 10 contacts with the stationary contact 8*a*, the power source 20 forms a closed circuit together with the display 30 for indicating the phase deficiency. A lower end of the movable contactor 9 is elastically supported by a spring 11, so that the movable contactor 9 is always upwardly biased by means of the spring 11.

The interlock lever 12, which is moved when the shifters horizontally move, is installed in the auxiliary device frame 7 in such a manner that the interlock lever 12 can rotate about a pin 13. In order to transfer power of the second shifter 5 to the interlock lever 12, a connection bar 14 is positioned between the interlock lever 12 and the second shifter 5 in such a manner that the connection bar 14 contacts with both of second shifter 5 and the interlock lever 12. One side of the connection bar 14 is connected to one side of the second shifter 5, and a protrusion 14*a* formed at the other side of the connection bar 14 is inserted into a hole 12*a* of the interlock lever 12.

Therefore, when the second shifter 5 horizontally moves, the connection bar 14 also moves together with the second shifter 5 so that the interlock lever 12 rotates about the pin 13.

A latch lever 15 is rotatably installed about a shaft 15*a* adjacent to the interlock lever 12.

The latch lever 15 is provided at one end thereof with a vertically movable engaging pin 16. In addition, a spring (not shown) is installed below the engaging pin 16 so as to upwardly bias the engaging pin 16.

A leading end of the latch lever 15 can be located in a moving route of the movable contactor 9 or can move out of the moving route of the movable contactor 9 so as to restrict the vertical movement of the movable contactor 9 or to allow the movable contactor 9 to vertically move. A upper end of the engaging pin 16 is disposed at a position to contact with a side portion of the interlock lever 12.

In addition, as shown in FIG. 2, the phase deficiency display device of the thermal magnetic type molded case circuit breaker includes the power source 20 for supplying power and the display 30 for displaying the phase deficiency state of the circuit when current is supplied from the power source 20 because the movable contact 10 contacts with the stationary contact 8*a* In addition, the display 30 stops its display operation when current supplied from the power source 20 is shut off because the movable contact 10 is separated from the fixed contact 8*a* According to a preferred embodiment of the present invention, any one of a lamp, which is switched on for indicating the phase deficiency state, a liquid crystal display for displaying information, such as "phase deficiency occurred", or a light emitting device positioned next to a phase deficiency marking and switched on when the phase deficiency occurs can be used as the display 30. Instead of or in addition to the display 30, it is also possible to use a buzzer, which generates an alarm sound by forming a closed circuit if the movable contact to contact with the stationary contact when the phase deficiency in the circuit occurs.

Hereinafter, an operation of the phase deficiency display device of the thermal magnetic type molded case circuit breaker having the above structure will be described.

Figure 4A:
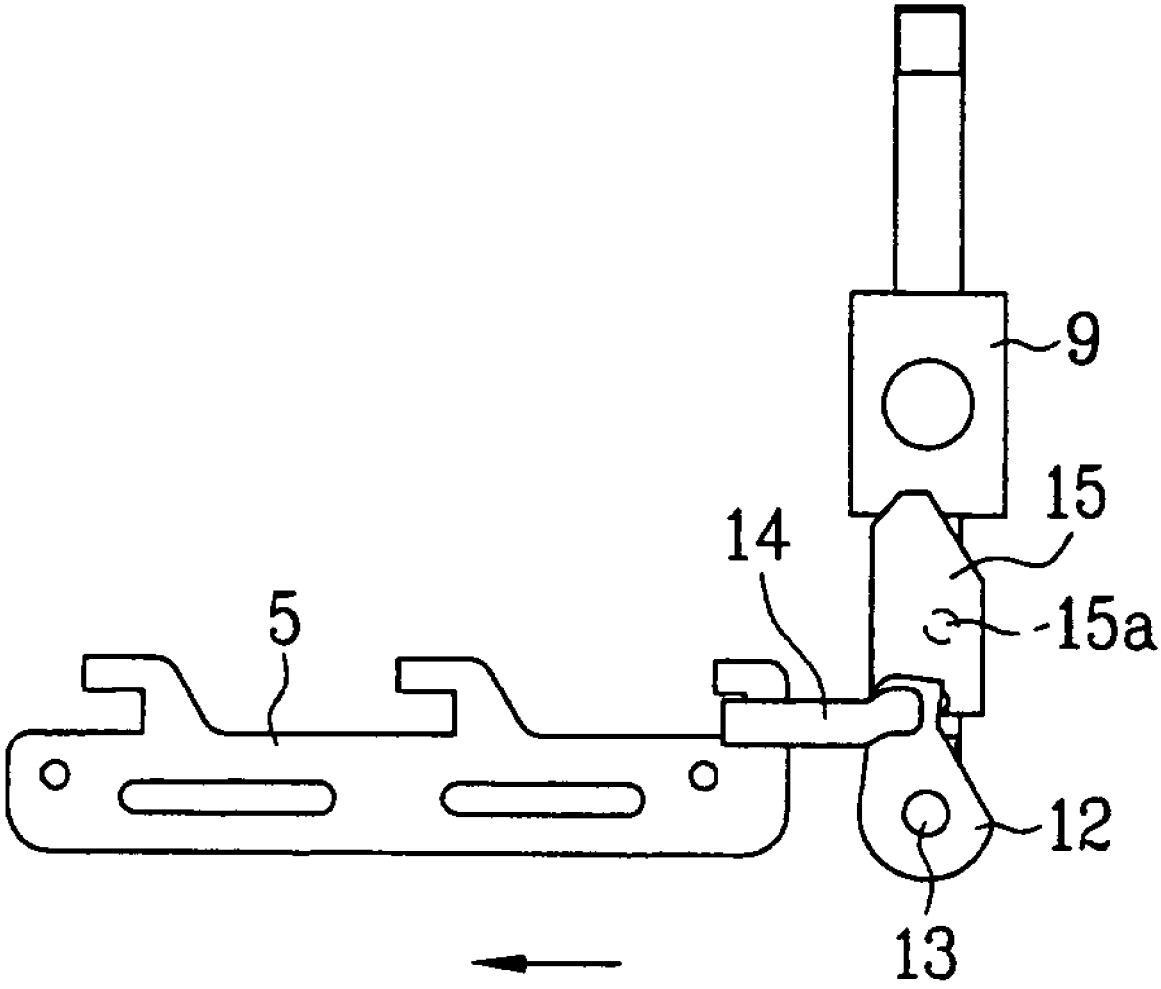
Figure 4B:
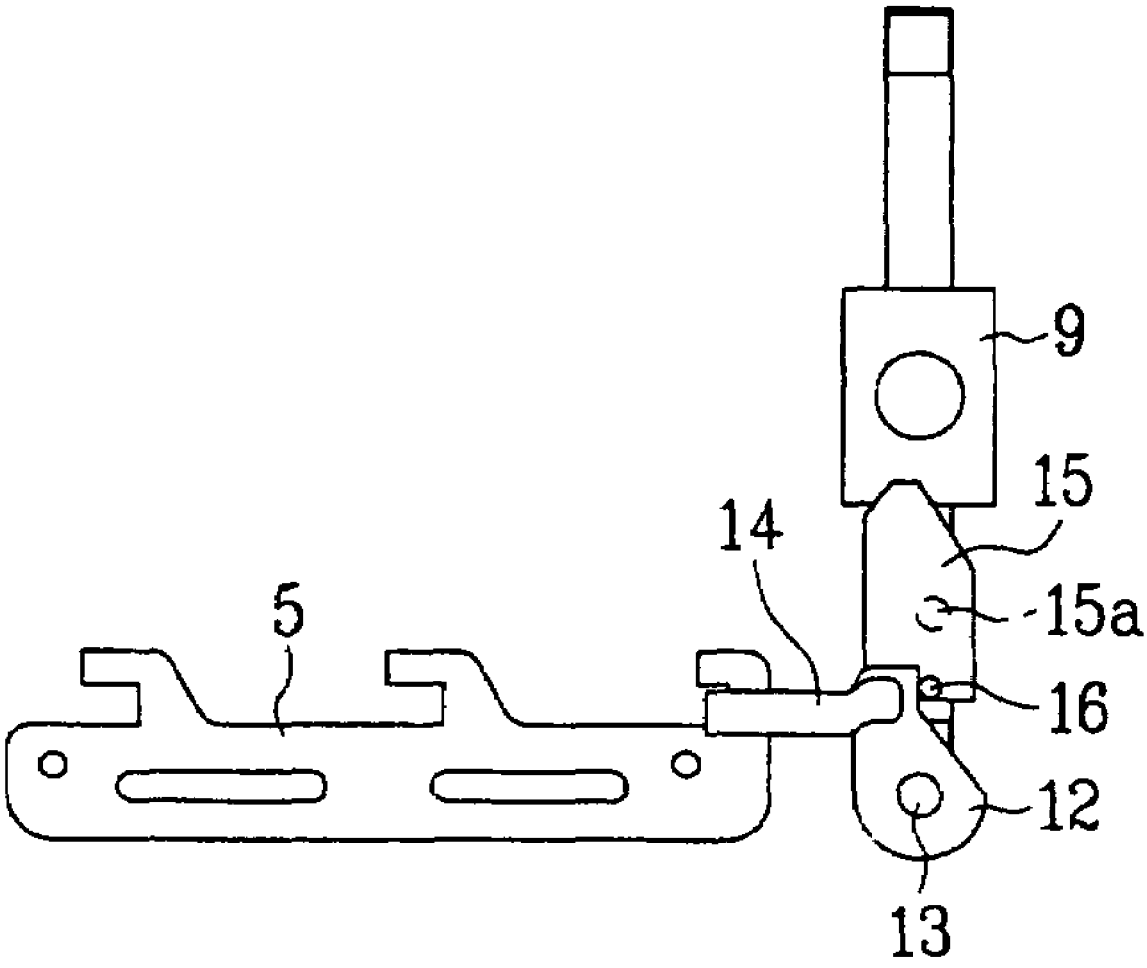
Figure 4C:
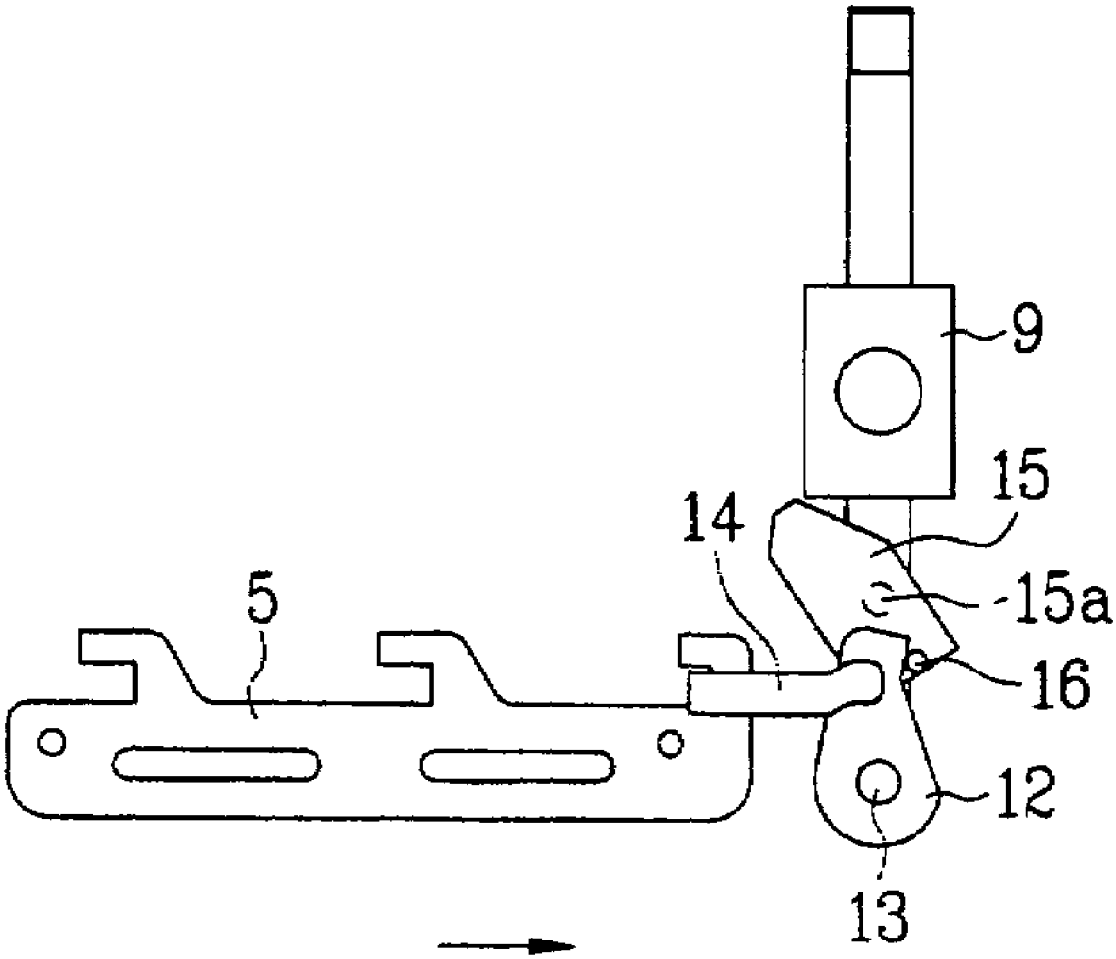

FIGS. 4A to 4C are operational views of the phase deficiency display device of the thermal magnetic type molded case circuit breaker according to one embodiment of the present invention. FIG. 4A represents a state before power is applied to the thermal magnetic type molded case circuit breaker, FIG. 4B represents a normal state of the thermal magnetic type molded case circuit breaker, and FIG. 4C represents a trip state of the thermal magnetic type molded case circuit breaker due to the phase deficiency.

Figure 5A:
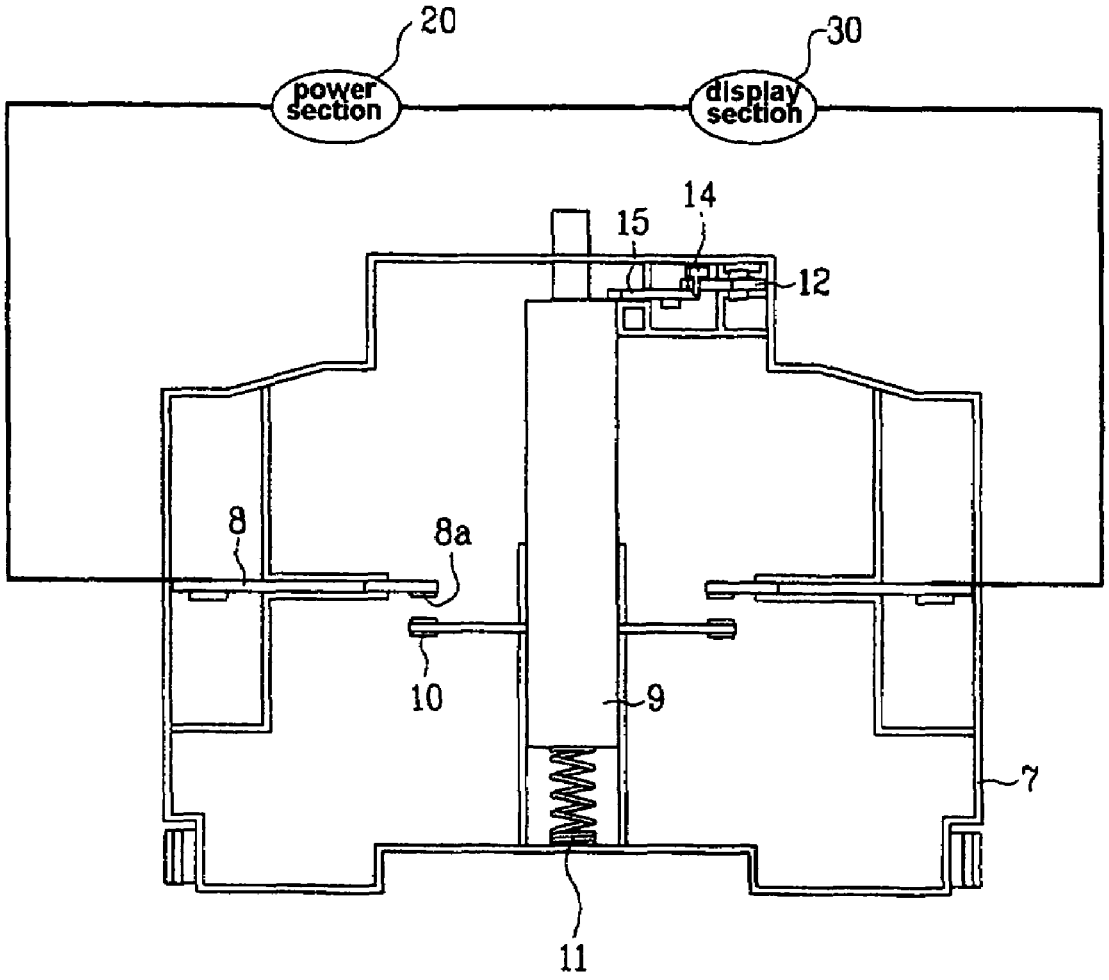
Figure 5B:
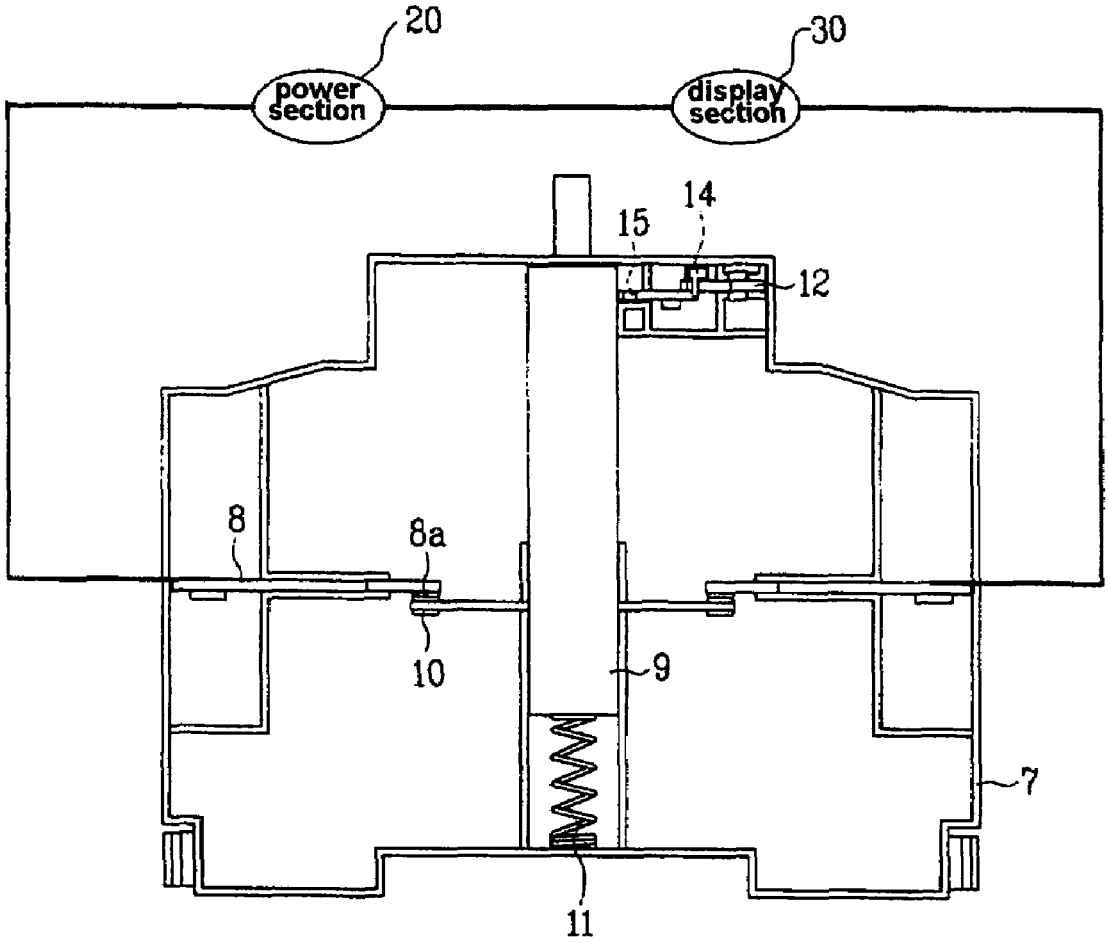

In addition, FIGS. 5A and 5B are views showing the phase deficiency display device of the thermal magnetic type molded case circuit breaker according to one embodiment of the present invention. FIG. 5A represents the normal state of the thermal magnetic type molded case circuit breaker, and FIG. 5B represents the trip state of the thermal magnetic type molded case circuit breaker due to the phase deficiency.

Referring to FIG. 4A, the engaging pin 16 installed on the latch lever 15 is pressed by the interlock lever 12 so that the engaging pin 16 maintains in a non-protruding state. In addition, the leading end of the latch lever 15 is located at a predetermined position for restricting an upward movement of the movable contactor 9.

At this time, although the movable contactor 9 is upwardly biased due to elastic force of the spring 11, the upward movement of the movable contactor 9 is restricted by means of the latch lever 15. Thus, the stationary contact 8*a* of the stationary contactor 8 is spaced from the movable contact 10 of the movable contactor 9 by a predetermined distance.

In this state, power is applied to the molded case circuit breaker so that rated current flows through the molded case circuit breaker. Accordingly, the bimetal 2 bends by a predetermined degree so that the first and second shifters 4 and 5 move in the left direction in the figure by a predetermined distance. At this time, as shown in FIG. 4B, the interlock lever 12 connected to the second shifter 5 through the connection bar 14 rotates counterclockwise about the pin 13. Thus, the engaging pin 16 installed on the latch lever 15 is upwardly protruded due to elastic force of the spring (not shown) installed below the lower end of the engaging pin 16, so the engaging pin 16 contacts with one side portion of the interlock lever 12.

At this time, since the latch lever 15 restricts the upward movement of the movable contactor 9, the stationary contact 8*a* is spaced from the movable contact 10.

However, if the phase deficiency occurs in the molded circuit breaker, the bimetal for a deficient phase is cooled so that the bimetal, which has bent, recovers its initial shape. Thus, the second shifter 5, which has been moved in the left direction due to the bending action of the bimetal, moves in the right direction according to the recovery action of the bimetal.

As shown in FIG. 4C, when the second shifter 5 has moved in the right direction, the interlock lever 12 connected to the second shifter 5 through the connection bar 14 rotates clockwise about the pin 13. At this time, since the engaging pin 16 is protruded towards one side of the connection lever 12, rotational force of the interlock lever 12 is transferred to the latch lever 15 by means of the engaging pin 16 so that the latch lever 15 rotates counterclockwise about the shaft 15*a*. In addition, since the front end of the latch lever 15 is shifted from its initial position due to the rotation of the latch lever 15, the movable contactor 9 can be released from the restriction caused by the leading end of the latch lever 15.

Accordingly, the movable contactor 9 moves upwards due to elastic force of the spring 11 so that the movable contact 10 of the movable contactor 9 contacts with the stationary contact 8*a* of the stationary contactor 8 as shown in FIG. 5B.

The display 30 does not operate if the phase deficiency does not occur because power is not applied to the display 30 due to a disconnection between the movable contact 10 and the stationary contact 8*a* However, if the movable contact 10 contacts with the stationary contact 8*a* due to the phase deficiency, an electric circuit including the power source 20, the contacts 10, 8*a* and the display 30 forms the closed circuit, so that the display 30 can display the phase deficiency of the molded case circuit breaker. Thus, the user can recognize the phase deficiency and the trip of the molded case circuit breaker.

As described above, the display device of the thermal magnetic type molded case circuit breaker further includes a function of displaying the trip of the molded case circuit breaker due to the phase deficiency in addition to a function of displaying the trip of the molded circuit breaker due to over-current and instantaneous current, so the user can rapidly deal with the phase deficiency and can prevent loss caused by over-heating generated due to the phase deficiency in advance. Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A phase deficiency display device for a thermal magnetic type molded case circuit breaker provided with a bimetal member, which is bendable when heat is applied thereto, and a shifter coupled to an upper end of the bimetal member and horizontally movable in correspondence to a bending degree of the bimetal member when over-current is applied thereto, the display device comprising:

a power source for supplying electric power;

a display connected to the power source for displaying a phase deficiency;

a stationary contactor electrically connected to the power source and having a stationary contact;

a movable contactor electrically connected to the display and having a movable contact, the movable contactor being vertically movable and forming a circuit together with the power source and the display for displaying a phase deficiency condition when the movable contact contacts the stationary contact;

an interlock lever rotatable in accordance with a horizontal movement of the shifter;

a connection bar connected to the shifter and to the interlock lever for transferring a horizontal moving force of the shifter to the interlock lever; and a latch lever installed adjacent to and in mechanical communication with the interlock lever for restricting movement of the movable contactor when normal current is applied and to release the movement restriction of the movable contactor when the phase deficiency occurs.

2. The display device according to claim 1, wherein the movable contactor is elastically supported by an elastic member such that the movable contactor is vertically biased in an upward direction.

3. The display device according to claim 1, wherein the connection bar includes a first protrusion provided at one end of the connection bar configured to be coupled with the shifter, and a second protrusion provided at the other end of the connection bar configured to be coupled with the connection lever.

4. The display device according to claim 1, wherein the latch lever is provided, at one end, with a vertically movable engaging pin, to which an elastic force is applied, such that the latch lever is rotated together with the interlock lever by engagement of the interlock lever with the engaging pin.

5. The display device according to claim 1, wherein the display includes one of a lamp, a liquid crystal display, or a light emitting device.

6. The display device according to claim 1, further comprising a buzzer generating an alarm sound when the movable contact contacts with the stationary contact due to the phase deficiency.

* * * * *